United States Patent [19]

Stuetz

[11] 4,397,321

[45] Aug. 9, 1983

[54] SMOKING PREPARATIONS

[75] Inventor: Dagobert E. Stuetz, Watchung, N.J.

[73] Assignee: Celanese Corporation, New York, N.Y.

[21] Appl. No.: 295,898

[22] Filed: Aug. 24, 1981

[51] Int. Cl.[3] ..... A24B 15/28; A24B 15/30; A24B 15/42

[52] U.S. Cl. ..... 131/334; 131/352; 131/359; 131/342; 131/343

[58] Field of Search ..... 131/342, 334, 359, 343, 131/369

[56] References Cited

U.S. PATENT DOCUMENTS

| | | | |
|---|---|---|---|
| 3,664,352 | 5/1972 | Norman et al. | 131/334 |
| 4,002,176 | 1/1977 | Anderson | 131/359 |
| 4,183,362 | 1/1980 | Norman et al. | 131/334 |
| 4,256,126 | 3/1981 | Seligman et al. | 131/359 |
| 4,296,762 | 10/1981 | Eicher et al. | 131/359 |
| 4,333,484 | 6/1982 | Keritsis | 131/359 |

*Primary Examiner*—V. Millin

*Attorney, Agent, or Firm*—DePaoli & O'Brien

[57] ABSTRACT

This invention provides tobacco and non-tobacco smoking compositions which deliver smoke of reduced tar and nicotine content, and with a substantially reduced carbon monoxide content.

In one of its embodiments this invention provides smoking preparations which contain a combustible filler, and uniformly dispersed therein a catalyst composition consisting of (a) fine ash, and (b) a transition metal compound.

14 Claims, No Drawings

SMOKING PREPARATIONS

BACKGROUND OF THE INVENTION

The inhalation of smoke which is generated from a smoking preparation is known to be a health hazard. The smoke which results from the combustion of tobacco and tobacco substitutes contains carbon monoxide, hydrogen cyanide, formaldehyde, acrolein, nicotine, phenols, tars, polycyclic hydrocarbons, and other such toxic components. There has been sustained investigative effort to develop cigarette products and other manufactured smoking compositions which deliver smoke with a reduced content of toxic components.

U.S. Pat. No. 2,003,690 describes a tobacco composition containing an inorganic oxidizing agent which is capable of yielding its oxygen to afford more complete combustion of aldehyde and other products of partial combustion during smoking.

U.S. Pat. No. 3,338,246 describes a smoking tobacco preparation containing a catalyst composition consisting essentially of an absorbent and catalytically active metal having a vapor pressure below one atmosphere at 1000° C. The objective of the patent invention is to provide a smoking preparation which on burning causes less irritation in the human body and yet retains a pleasant taste.

U.S. Pat. No. 3,472,237 describes a method of treating tobacco to diminish the carbon monoxide which is released during the smoking process, which method involves impregnating the tobacco with a metal oxide selected from iron, calcium and copper oxides. The metal oxide is employed in the form of an aqueous dispersion with a carrier selected from reducing sugars. As a subsequent step, the impregnated tobacco is irradiated with visible light in the range of 4000–7000 Å and ultraviolet light below about 3400 Å to form a photochemical non-staining complex of the tobacco and the metal oxide.

U.S. Pat. No. 3,572,348 describes a smoking preparation comprising tobacco and a zeolite material which effects a decrease in the amounts of polycyclic aromatic compounds produced by the pyrolytic reactions of tobacco. The zeolite material is of the Y-type structure, preferably at least partially exchanged with zinc ions or containing metallic palladium, or at least partially exchanged with zinc ions and containing metallic palladium or is partially polyvalent zinc cation exchanged and partially decationized and contains metallic palladium.

U.S. Pat. No. 3,893,464 describes a smoking composition containing tobacco, and a combination of a catalytic agent and a nitric oxide releasing additive for reducing the concentration of polycyclic aromatic hydrocarbons in generated tobacco smoke. Illustrative of the catalytic agent is zine oxide, and the nitric oxide releasing additive preferably is selected from magnesium, calcium and zinc nitrates.

U.S. Pat. No. 4,125,118 describes a smoking composition which has incorporated a catalytic quantity of a transition metal compound to reduce the amount of toxic materials in released smoke without adversely affecting the organoleptic properties of the smoking composition or its smoke. The transition metal compounds employed to reduce the toxic materials in the smoke of tobacco and tobacco substitutes are those that are capable of promoting the oxidation of the toxic materials and in which the toxic materials are at least moderately soluble. They include transition metal salts of monocarboxylic acids having 4–24 carbon atoms, overbased metal salts of these monocarboxylic acids, amine complexes of transition metal salts of these monocarboxylic acids, and mixtures thereof.

There is increasing public awareness and governmental concern with respect to the health hazards associated with the inhalation of smoke delivered by manufactured smoking products.

Accordingly, it is a main object of this invention to provide novel smoking preparations which deliver smoke of reduced toxicity under normal smoking conditions.

It is another object of this invention to provide smoking tobacco compositions which deliver mainstream smoke with a reduced tar and nicotine content, and with a substantially reduced carbon monoxide content. k Other objects and advantages of the present invention shall become apparent from the accompanying description and examples.

DESCRIPTION OF THE INVENTION

One or more objects of the present invention are accomplished by the provision of a smoking preparation comprising (1) a combustible filler, and uniformly dispersed therein (2) a catalyst composition comprising (a) at least one component selected from potassium and calcium compounds, and (b) at least one component selected from transition metal compounds.

The combustible filler is selected from natural tobacco, reconstituted tobacco and non-tobacco substitutes.

The quantity of catalyst composition uniformly dispersed in the combustible filler preferably is in the range between about 0.005–10 weight percent, based on the weight of filler.

The catalyst composition, typically is composed of (a) between about 1–10 parts by weight of at least one component selected from potassium and calcium compounds, and (b) between about 0.5–10 parts by weight of at least one component selected from transition metal compounds. It is highly advantageous that between about 1–10 parts by weight of both potassium and calcium compounds are present, in addition to the transition metal component of the catalyst.

Illustrative of potassium and calcium compounds suitable as catalyst components are those which are capable of promoting the oxidation of toxic materials in smoke, such as potassium and calcium compounds in the form of oxides, hydroxides, nitrates, carbonates, permanganates, carboxylic acid salts, and the like.

Illustrative of transition metal compounds which are suitable as catalyst components are the oxides and hydroxides of transition metals which have an atomic number in the range of 21–30 or 39–48, inclusive. Particularly preferred transition metal compounds are oxides of iron and manganese.

It is an important aspect of a present invention smoking preparation that the catalyst composition is uniformly dispersed throughout the combustible filler matrix, and that the dispersed catalyst composition is in the form of a fine powder having a particle size less than about 77 microns. In terms of mesh size, the catalyst composition particles should be small enough to pass through a 170 mesh screen.

Other conditions being equal, the efficiency of toxic material reduction in smoke delivered by a present invention smoking preparation increases as the particle size of the incorporated catalyst component decreases. For example, the achievement of a 37% conversion of carbon monoxide to carbon dioxide in the mainstream smoke of a cigarette under a controlled set of test conditions, requires about 400 mg/cigarette of 8 mesh manganese dioxide, 180 mg/cigarette of 120 mesh manganese dioxide, 120 mg/cigarette of cryomilled manganese dioxide, and 55 mg/cigarette of colloidal manganese dioxide, respectively.

In another embodiment, this invention provides a smoking preparation comprising a combustible filler having fine ash uniformly dispersed therein.

By the term "ash" as employed herein is meant a fine powder which is obtained as a residual material from the combustion of natural cellulosic biomass. Illustrative of cellulosic sources are tobacco waste products such as stalks, ribs and fragments; wood materials such as sawdust, woodpulp, paper and cardboard; solid organic agricultural wastes as derived in the form of wheat straw, rice straw, rye straw, maize husks and stalks, sugar cane bagasse, and other cellulosic agricultural byproducts; and the like.

In a further embodiment, this invention provides a smoking preparation comprising a combustible filler, and uniformly dispersed therein a catalyst composition comprising (a) fine ash, and (b) at least one component selected from transition metal compounds.

Illustrative of a preferred species of this embodiment is a smoking preparation comprising (1) combustible filler selected from natural tobacco, reconstituted tobacco and non-tobacco substitutes, and uniformly dispersed therein (2) between about 0.005–10 weight percent, based on the weight of filler, of a catalyst composition comprising (a) between about 1–10 parts by weight of ash, and (b) between about 0.5–10 parts by weight of at least one component selected from iron and manganese compounds; wherein the particle size of the catalyst composition is less than about 77 microns.

In the case of a present invention smoking preparation which has a fine ash component uniformly dispersed in the combustible filler, it is advantageous to employ a water-soluble fraction of ash rather than the total ash. The water-soluble fraction is that which is obtained by extracting an ash solid with water, and then evaporating the water extraction phase to yield the water-soluble solids fraction of the ash.

When a water-soluble ash fraction is employed as a component of a smoking preparation, there is little or no alteration of the color and appearance of the combustible filler, which alteration is an undesirable effect usually observed when unfractionated regular ash is incorporated as a component. In addition to this advantage, the catalytic efficiency of the water-soluble fraction of ash for the reduction of toxic materials in smoke is substantially equivalent to that of regular ash.

In another of its embodiments, this invention contemplates a method of reducing the carbon monoxide content of smoke delivered by a smoking preparation which comprises uniformly dispersing in the combustible filler of the smoking preparation prior to the smoking process a catalyst composition comprising (a) at least one component selected from potassium and calcium compounds, and (b) at least one component selected from transition metal compounds.

In a further embodiment, this invention contemplates a method of reducing the carbon monoxide content of smoke delivered by a smoking preparation which comprises uniformly dispersing in the combustible filler of the smoking preparation prior to the smoking process a catalyst composition comprising fine ash.

In a further embodiment, this invention contemplates a method of reducing the carbon monoxide content of smoke delivered by a smoking preparation which comprises uniformly dispersing in the combustible filler of the smoking preparation priot to the smoking process a catalyst composition comprising (a) fine ash, and (b) at least one component selected from transition metal compounds.

As demonstrated in the Examples of the present specification, it is to be noted that a uniquely efficient reduction of the toxic components delivered by a smoking preparation is achieved when the ash of a combusted smoking preparation of the present invention is backblended into new filler, and the new blend is subjected to smoking conditions.

PREPARATION OF SMOKING COMPOSITIONS

The present invention smoking compositions can be prepared by admixing tobacco and/or reconstituted tobacco and/or non-tobacco substitute filler with between about 0.005–10 weight percent, based on the weight of filler, of one of the catalyst systems described hereinabove.

The catalyst components can be incorporated into the filler matrix in accordance with methods known and used in the art. Prior to the uniform dispersion of the catalyst component into the filler matrix, the catalyst component can be combined with other additives such as humectants, binding agents, flavorants, and the like, which are employed to impart improved physical properties and burning characteristics to a smoking product.

The catalyst component and other additives can be dissolved in a solvent such as water, alcohol, or mixtures thereof, and then sprayed or injected into the filler matrix.

A convenient and effective method of incorporating the catalyst component is to admix the catalyst component with comminuted filler and then tumble the admixture until a uniform blend is achieved. The fine particles of the catalyst additive normally exhibit excellent adhesion to the high surface area of the tobacco or non-tobacco substitute filler.

The term "non-tobacco substitute" is meant to include smoking filler materials such as wood pulps, oxidized cellulose, pectins, and other such vegetable derivatives.

Illustratively, U.S. Pat. No. 3,529,602 describes a burnable sheet which may be used as a tobacco substitute, which sheet contains ingredients which include (1) a film-forming ingredient comprising a pectinaceous material derived from tobacco plant parts and having an acid value in excess of 30 milligrams of potassium hydroxide per gram, and (2) a mineral ingredient comprising an alkali metal salt, an alkaline earth metal salt or a clay.

U.S. Pat. No. 3,703,177 describes a process for preparing a non-tobacco smoking product from sugar beet pulp, which process involves the acid hydrolysis of the beet pulp to release beet pectins, and at least an alkaline earth treatment thereafter to cause crosslinking of the pectins and the formation of a binding agent for the exhausted beet matrix.

U.S. Pat. No. 3,796,222 describes a smoking product derived from coffee bean hulls. The hulls are treated with reagents that attack the alkaline earth metal crosslinks causing the release of the coffee pectins. The pectins act as a binding agent and together with the treated hulls may be handled and used similarly to a tobacco product.

U.S. Pat. No. 4,019,521 discloses a process for forming a smokable material which involves heating a cellulosic or carbohydrate material at a temperature of 150°-750° C. in an inert atmosphere for a period of time sufficient to effect a weight loss of at least 60 percent but not more than 90 percent.

The following examples are further illustrative of the present invention. The reactants and other specific ingredients are presented as being typical, and various modifications can be derived in view of the foregoing disclosure within the scope of the invention.

In the following examples, in order to evaluate the activity of different catalysts for removing CO from the main stream of tobacco smoke, self-rolled cigarettes were prepared and smoked under standard conditions (2 second puff of 35 ml, 58 seconds rest period). The volume of gases collected during the puff cycle was injected into the sample loop of a gas chromatograph and analyzed using the cryogenic mode (−70° C. to +170° C.). In the evaluation of the gas chromatograph, only peaks for $N_2$, $O_2$, CO, $CO_2$ and $H_2O$ were measured and equated to 100%. Other peaks, associated with organic components and usually of small magnitude, were disregarded. The catalyst was manually blended with standard U.S. tobacco, and fashioned into a cigarette with a hand-roller. Dimensions of the cigarette were 5 mm in diameter by 85 mm long, which is thinner than the 8 mm standard diameter. Since the standard weight of one gram of tobacco cigarette was used, the hand-rolled cigarettes had a tighter packing than the standardized version.

EXAMPLE I

This Example illustrates the effect of a palladium catalyst additive on the carbon monoxide content of smoke which is generated by cigarettes under test conditions.

A series of cigarettes were prepared and the volumes of gas constituents were determined by gas chromatography.

A second series of cigarettes were prepared which contained a quantity of palladium/carbon catalyst as a uniformly blended additive.

The results of the comparative tests are listed in Table I. A reduction of the carbon monoxide content of the cigarette smoke was achieved in the presence of the palladium/carbon catalyst. However, a relatively high level of palladium was required (i.e., 40 mg of palladium metal per gram of tobacco) to reduce the carbon monoxide content of the smoke by more than 50%, as compared to the control samples.

Similar results were obtained when manganese dioxide was employed as the catalyst additive. Colloidal manganese dioxide was more effective than granular manganese dioxide (8 mesh) for reduction of the carbon monoxide content of cigarette smoke. Colloidal manganese dioxide yielded a 37% carbon monoxide delivery reduction at 55 mg as compared with its same delivery reduction with 400 mg of the granular material. The tests also indicated that an approximately 33% carbon monoxide delivery reduction was accompanied by a delivery reduction of nicotine (64%) and tar (55%).

TABLE I

| | $N_2$ | $O_2$ | CO | $CO_2$ | $H_2O$ | $CO_2$/-CO | % CO OF CONTROL |
|---|---|---|---|---|---|---|---|
| CONTROL | 65.8 | 16.9 | 4.26 | 10.0 | 3.1 | 2.35 | |
| | 66.6 | 16.3 | 4.38 | 10.5 | 2.2 | 2.40 | |
| | 65.5 | 15.9 | 5.2 | 10.6 | 2.8 | 2.04 | |
| | 65.5 | 15.8 | 5.3 | 11.5 | 1.8 | 2.22 | |
| +40 mg Pd/C(1) per 1 gm. tobacco | 67.7 | 14.6 | 2.7 | 11.9 | 3.0 | 4.42 | 50.6 |
| | 67.2 | 14.8 | 2.7 | 11.1 | 1.4 | 4.17 | 53.7 |
| +400 mg Pd/C(2) per 1 gm. tobacco | 71.7 | 19.0 | 1.09 | 8.48 | 1.42 | 7.75 | 28.9 |
| Control with Carlton Filter Tip | 74.2 | 19.6 | 0.81 | 2.97 | 2.47 | 3.66 | 100 |
| +400 mg Pd/C(2) per 1 gm. tobacco | 76.2 | 19.7 | 0.11 | 2.23 | 1.81 | 20.4 | 17.9 |

(1)equal to 4 mg. Pd metal/1 gm. tobacco
(2)equal to 40 mg. Pd metal/1 gm. tobacco

EXAMPLE II

This Example illustrates the preparation of cigarettes in accordance with the present invention, and the reduced carbon monoxide content of the smoke generated by the cigarettes.

The cigarettes were hand-rolled employing tobacco/catalyst blends, and contained one gram of tobacco plus the weight of catalyst additive.

All analyses were based on a single puff taken near the point of a cigarette where the burn line has reached 35 mm. This point yielded a smoke sample which approximated the average of the smoke composition delivered by a cigarette over the whole smoking cycle. Smoke concentration rises from a low level at the initial puff to a high level at the last puff at 55 mm.

Smoke samples were analyzed with a Varian 1700/Poropak Q column at −70° C. for $N_2$, $O_2$ and CO, followed by a 20° C./min programmed rise to 250° C. for $CO_2$ and $H_2O$. The system was calibrated with a Matheson certified mixture of $CO/CO_2$ which was diluted with air in a syringe to give known peak ratios for $N_2/O_2$ and $CO/CO_2$ from which TC factors were estimated.

Table II lists the results of a series of cigarette smoking runs, and the volume % analyses and $CO_2$/CO ratios for the runs. Each catalyst additive was a blend of a transition metal oxide and ash.

Table III lists the results of a series of cigarette smoking runs, and the volume % analyses and $CO_2$/CO ratios for the runs. A "simulated" ash is a synthetic additive containing at least one component selected from potassium and calcium compounds. In Table III, Ac is acetate and DiCPD is dicyclopentadiene.

TABLE II

| TRANSITION METAL OXIDE/ASH BLENDS | | | | | | |
|---|---|---|---|---|---|---|
| ADDITIVE | Vol % | | | | | V/V |
| (Per gm Tobacco) | $N_2$ | $O_2$ | CO | $CO_2$ | $H_2O$ | $CO_2$/CO |
| 20 mg $Fe_2O_3$/80 mg Ash | 72.2 | 16.4 | 2.62 | 8.21 | 0.59 | 3.14 |
| Ash* (13 mg $Fe_2O_3$) | 71.9 | 16.9 | 2.61 | 7.62 | 1.02 | 2.92 |
| 20 mg $Fe_2O_3$/80 mg Ash | 71.40 | 16.79 | 2.50 | 7.62 | 1.69 | 3.04 |

TABLE II-continued

| TRANSITION METAL OXIDE/ASH BLENDS | | | | | | |
|---|---|---|---|---|---|---|
| ADDITIVE | Vol % | | | | | V/V |
| (Per gm Tobacco) | $N_2$ | $O_2$ | CO | $CO_2$ | $H_2O$ | $CO_2/CO$ |
| Ash* (13 mg $Fe_2O_3$) | 69.41 | 14.84 | 3.36 | 9.96 | 2.38 | 2.96 |
| 10 mg $Fe_2O_3$/90 mg Ash | 71.26 | 15.92 | 2.99 | 8.60 | 1.23 | 2.87 |
| Ash* (6.5 mg $Fe_2O_3$) | 70.46 | 15.87 | 2.90 | 8.67 | 2.10 | 2.99 |
| 10 mg $Fe_2O_3$/190 mg Ash | 69.56 | 14.52 | 3.35 | 10.75 | 1.83 | 3.21 |
| Ash* | 70.32 | 15.00 | 3.56 | 10.14 | 0.99 | 2.85 |
| 25 mg $Fe_2O_3$/25 mg $MnO_2$/50 mg Ash | 71.65 | 16.59 | 2.86 | 7.90 | 0.99 | 2.76 |
| Ash* | 70.52 | 14.91 | 3.75 | 10.13 | 0.70 | 2.70 |
| CONTROL (1 gm tobacco) | 71.50 | 12.60 | 4.75 | 10.36 | 0.82 | 2.18 |

*100 mg of cigarette ash from previous run; backblended into new tobacco.

TABLE III

| SIMULATED ASH AND CALCINED MATERIALS | | | | | | |
|---|---|---|---|---|---|---|
| ADDITIVE | Vol % | | | | | V/V |
| (Per gm Tobacco) | $N_2$ | $O_2$ | CO | $CO_2$ | $H_2O$ | $CO_2/CO$ |
| 100 mg Mixture 1/1 of $Fe_2O_3$/CaO | 71.46 | 13.29 | 3.75 | 9.81 | 1.69 | 2.61 |
| Ash* | 74.44 | 15.75 | 2.05 | 7.36 | 0.41 | 3.60 |
| 100 mg Mixture 60/40 of $MnO_2$/CaO | 70.92 | 12.22 | 4.96 | 11.16 | 0.75 | 2.25 |
| Ash* | 73.41 | 14.49 | 3.16 | 8.93 | ? | 2.82 |
| 25 mg $Fe_2O_3$/-50 mg $CaCO_3$/-25 mg KCl | 72.0 | 16.6 | 2.73 | 8.02 | 0.72 | 2.99 |
| Ash* (16 mg $Fe_2O_3$) | 71.6 | 15.8 | 3.08 | 8.77 | 0.75 | 2.84 |
| 25 mg $Fe_2O_3$/-25 mg $MnO_2$/50 mg $K_2CO_3$ | 72.05 | 16.78 | 2.69 | 7.86 | 0.63 | 2.94 |
| 100 mg of calcined mixture (400 $Fe^{III}$AcAc/-100 KOAc/100$K_2Co_3$) (30 mg $Fe_2O_3$) | 72.11 | 17.61 | 2.02 | 6.32 | 1.94 | 3.14 |
| Ash* | 71.23 | 16.31 | 2.67 | 8.23 | 1.57 | 3.06 |
| 100 mg of calcined mixture ($Fe^{II}$DiCPD, $Fe^{III}$AcAc, $K_2CO_3$, $CaCO_3$), containing 0.7% Fe, 39.4% K, 19.9% Ca by emission spec. | 70.90 | 15.30 | 2.81 | 9.52 | 1.47 | 3.39 |
| Ash* | 72.56 | 17.89 | 1.85 | 5.64 | 2.06 | 3.05 |
| CONTROL (1 gm tobacco) | 71.50 | 12.60 | 4.75 | 10.36 | 0.82 | 2.18 |

*100 mg of cigarette ash from previous run; backblended into new tobacco.

EXAMPLE III

This Example illustrates the use of ash and fractionated ash as additives in smoking preparation.

Table IV lists a metal analysis by emission spectroscopy of cigarette ash.

Table V is a diagram of a procedure for fractionating cigarette ash into water-soluble and water-insoluble fractions. The elemental analyses of the fractions are listed.

Table VI reports the comparative results of a series of smoking tests on tobacco containing ash and fractionated ash fractions as catalytic agents for carbon monoxide oxidation to carbon dioxide.

TABLE IV

| METAL ANALYSIS BY EMISSION SPECTROSCOPY OF CIGARETTE ASH | |
|---|---|
| METAL | WEIGHT % |
| B | <0.1 |
| Si | 3. |
| Mn | 0.3 |
| Mg | 5. |
| Fe | 1. |
| Al | 2. |
| Ca | 20. |
| Cu | 0.03 |
| Ti | 0.2 |
| Sr | 0.1 |
| K | 12. |

Not detectable (<0.1%): Ba, P, Sb, Pb, Sn, Cr, Ni, Mo, V, Na, Zn, Cd, Ag, Zr, Co.

TABLE V

CIGARETTE ASH SEPARATION

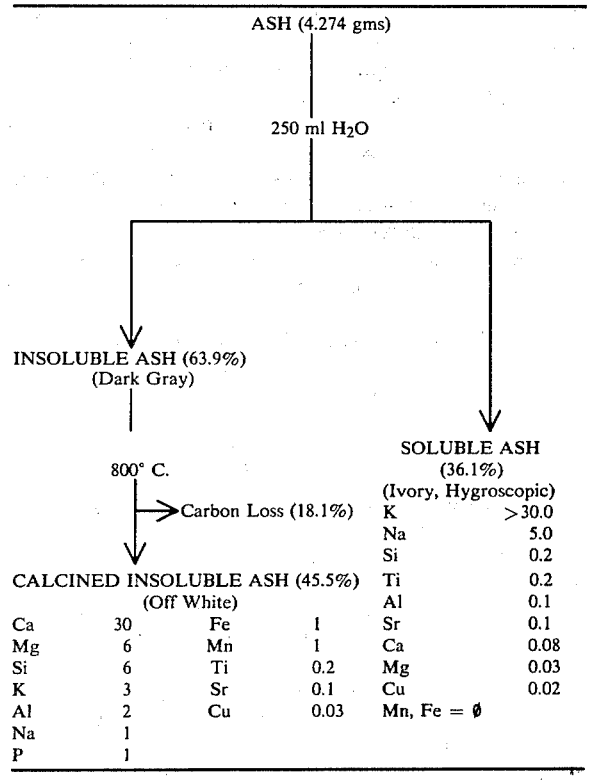

TABLE VI

| WATER SOLUBLE & INSOLUBLE CIGARETTE ASH | | | | | | |
|---|---|---|---|---|---|---|
| ADDITIVE | Vol % | | | | | V/V |
| Per gm Tobacco | $N_2$ | $O_2$ | CO | $CO_2$ | $H_2O$ | $CO_2/CO$ |
| Total Ash | | | | | | |
| 100 mg | 71.8 | 14.8 | 3.58 | 9.0 | 0.85 | 2.51 |
| 250 mg | 73.2 | 17.8 | 2.23 | 6.27 | 0.88 | 2.82 |
| Soluble Ash | | | | | | |
| 80 mg | 72.8 | 17.6 | 2.20 | 6.70 | 0.66 | 3.04 |
| 1st Rerun (135 mg) | 72.1 | 17.5 | 2.32 | 7.38 | 0.70 | 3.18 |
| 2nd Rerun (157 mg) | 71.4 | 16.2 | 2.70 | 8.75 | 0.94 | 3.24 |
| Insoluble Ash | | | | | | |
| 80 mg | 69.8 | 14.2 | 4.41 | 10.90 | 0.76 | 2.47 |
| 1st Rerun (125 mg) | 70.7 | 15.2 | 3.24 | 9.65 | 1.22 | 2.98 |
| 2nd Rerun (170 mg) | 70.4 | 14.9 | 3.27 | 10.10 | 1.38 | 3.09 |
| Sol/Insoluble | | | | | | |
| 80/80 mg | 71.4 | 15.9 | 2.73 | 9.25 | 0.69 | 3.33 |
| 1st Rerun (155 mg) | 70.4 | 14.6 | 3.21 | 10.42 | 0.77 | 3.25 |
| 2nd Rerun (175 mg) | 70.5 | 14.8 | 3.26 | 10.24 | 1.23 | 3.14 |

TABLE VI-continued

| WATER SOLUBLE & INSOLUBLE CIGARETTE ASH | | | | | | |
|---|---|---|---|---|---|---|
| ADDITIVE | Vol % | | | | | V/V |
| Per gm Tobacco | $N_2$ | $O_2$ | CO | $CO_2$ | $H_2O$ | $CO_2/CO$ |
| CONTROL | 71.50 | 12.60 | 4.75 | 10.36 | 0.82 | 2.18 |

What is claimed is:

1. A smoking preparation comprising a tobacco filler having fine ash uniformly dispersed therein in an effective amount to reduce carbon monoxide content of smoke delivered by a tobacco filler.

2. A smoking preparation in accordance with claim 1 wherein the ash component is tobacco ash.

3. A smoking preparation comprising (1) a tobacco filler, and uniformly dispersed therein (2) a catalyst composition comprising (a) fine ash, and (b) at least one component selected from transition metal compounds.

4. A smoking preparation comprising (1) combustible filler selected from natural tobacco and reconstituted tobacco, and uniformly dispersed therein (2) between about 0.005–10 weight percent, based on the weight of filler, of the catalyst composition comprising (a) between about 1–10 parts by weight of at least one component selected from potassium and calcium compounds, and (b) between about 0.5–10 parts by weight of at least one component selected from iron and manganese compounds; wherein the particle size of the catalyst composition is less than about 77 microns.

5. A smoking prepartion comprising (1) combustible filler selected from natural tobacco and reconstituted tobacco, and uniformly dispersed therein (2) between about 0.005–10 weight percent, based on the weight of filler, of a catalyst composition comprising ash; wherein the particle size of the catalyst composition is less than about 77 microns.

6. A smoking preparation in accordance with claim 5 wherein the catalyst composition is tobacco ash.

7. A smoking preparation comprising (1) combustible filler selected from natural tobacco and reconstituted tobacco, and uniformly dispersed therein (2) between about 0.005–10 weight percent, based on the weight of filler, of a catalyst composition comprising (a) between about 1–10 parts by weight of ash, and (b) between about 0.5–10 parts by weight of at least one component selected from iron and manganese compounds; wherein the particle size of the catalyst composition is less than about 77 microns.

8. A method of reducing the carbon monoxide content of smoke delivered by a smoking tobacco preparation which comprises uniformly dispersing in the tobacco filler of the smoking preparation prior to the smoking process a catalyst composition comprising fine ash.

9. A method in accordance with claim 8 wherein the catalyst composition is tobacco ash.

10. A method of reducing the carbon monoxide content of smoke delivered by a smoking tobacco preparation which comprises uniformly dispersing in the tobacco filler of the smoking preparation prior to the smoking process a catalyst composition comprising (a) fine ash, and (b) at least one component selected from transition metal compounds.

11. A method in accordance with claim 10 wherein the ash component of the catalyst composition is tobacco ash.

12. A smoking preparation comprising a combustible filler having fine ash uniformly dispersed therein, wherein the ash component consists of the water-soluble fraction of ash.

13. A method of reducing the carbon monoxide content of smoke delivered by a smoking preparation which comprises uniformly dispersing in the combustible filler of the smoking preparation prior to the smoking process a catalyst composition consisting of the water-soluble fraction of ash.

14. A method of reducing the carbon monoxide content of smoke delivered by a smoking preparation which comprises uniformly dispersing in the combustible filler of the smoking preparation prior to the smoking process a catalyst composition comprising (a) the water-soluble fraction of ash, and (b) at least one component selected from transition metal compounds.

* * * * *